US005507916A

United States Patent [19]

Schiel

[11] Patent Number: 5,507,916

[45] Date of Patent: Apr. 16, 1996

[54] METHOD OF TREATING THE EDGES OF A FIBER WEB

[75] Inventor: Christian Schiel, Heidenheim, Germany

[73] Assignee: J.M. Voith GmbH, Heidenheim, Germany

[21] Appl. No.: 258,088

[22] Filed: Jun. 10, 1994

[30] Foreign Application Priority Data

Jun. 11, 1993 [DE] Germany ..... 43 19 323.4

[51] Int. Cl.[6] ..... D21F 3/02; D21F 3/06; B30B 3/00

[52] U.S. Cl. ..... 162/195; 162/194; 162/205; 162/210; 162/252; 162/358.3

[58] Field of Search ..... 162/198, 210, 162/205, 203, 358, 358.3, 358.1, 358.5, 194, 195, 361, 252, 262; 100/144, 214, 153, 18, 41; 492/5, 7, 10, 20

[56] References Cited

U.S. PATENT DOCUMENTS

| | | | |
|---|---|---|---|
| 3,119,324 | 1/1964 | Justus | 100/170 |
| 3,879,827 | 4/1975 | Lehmann | 492/5 |
| 4,307,501 | 12/1981 | Ahrweiler | 492/5 |
| 4,319,390 | 3/1982 | Wolf | 492/7 |
| 4,518,460 | 5/1985 | Hauser et al. | 162/361 |
| 4,556,454 | 12/1985 | Dahl et al. | 162/358 |
| 4,576,682 | 3/1986 | Laapotti | 162/358 |
| 4,705,602 | 11/1987 | Dahl | 162/358 |
| 4,856,157 | 8/1989 | Küsters | 492/7 |
| 4,917,767 | 1/1990 | Ilmarinen et al. | 162/358 |
| 5,141,601 | 8/1992 | Karlsson et al. | 162/358.3 |

*Primary Examiner*—David L. Lacey
*Assistant Examiner*—Jose A. Fortuna
*Attorney, Agent, or Firm*—Marshall, O'Toole, Gerstein, Murray & Borun

[57] ABSTRACT

A method of treating the edges of a fiber web is provided wherein a pressing device device conveys and presses a fiber web through a pressing gap of a pressing station of the device. The station includes a pressing roll and a counter roll. The pressing roll has a roll shell. A pressing shoe is disposed within the roll shell and pressing units are disposed substantially along a width of the pressing shoe transverse to the direction of movement of a fiber web through the pressing station. The pressing units press against the pressing shoe which in turn presses a pressing surface of the shoe against an inner surface of the roll shell in a series of zones. The pressing units including pressing/pressure relief elements. The pressing force of the pressing/pressure relief elements is reduced in a step-wise fashion, zone-by-zone, from a normal operating level to a lower level in a region that includes the fiber web edges and the pressing shoe ends.

15 Claims, 4 Drawing Sheets

Fig. 3
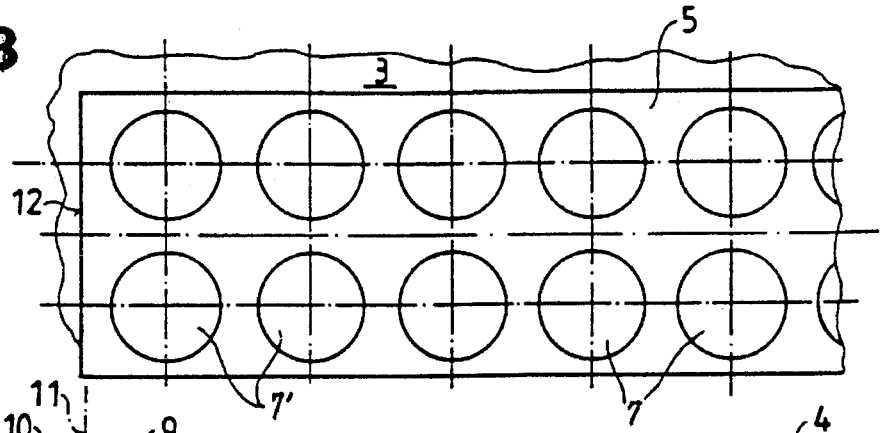
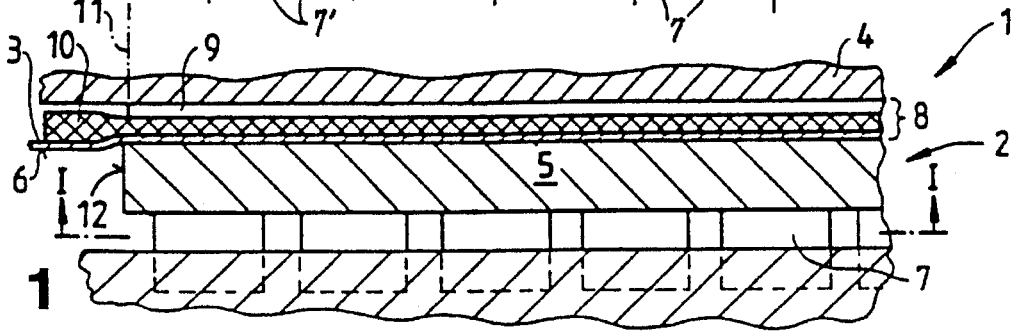
Fig. 1
Fig. 2
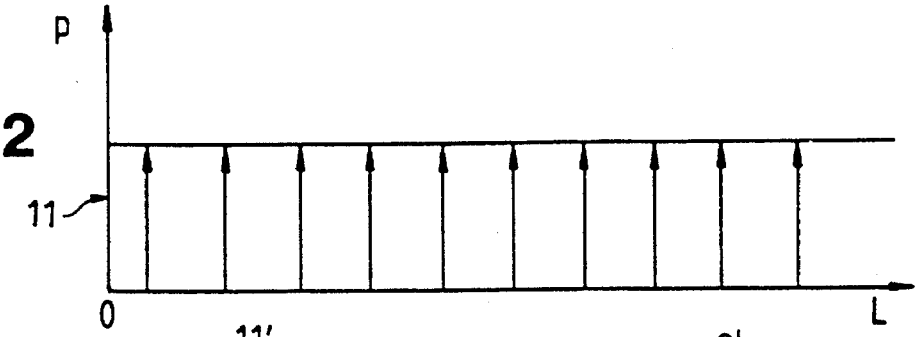
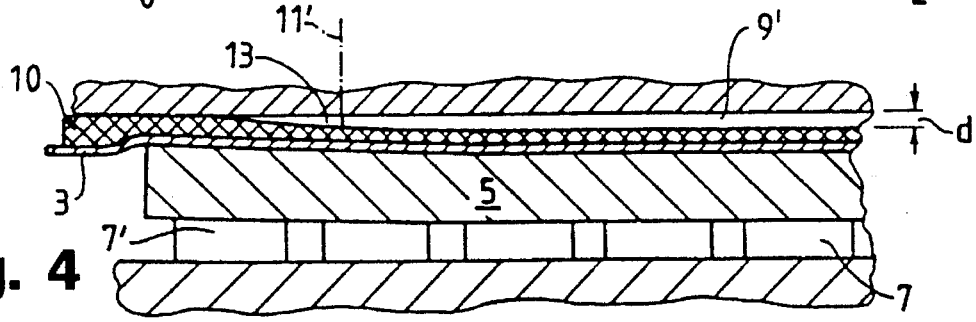
Fig. 4
Fig. 5
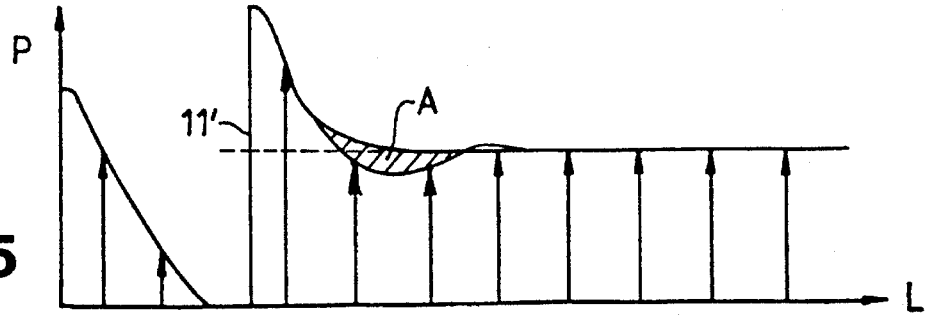

METHOD OF TREATING THE EDGES OF A FIBER WEB

BACKGROUND OF THE INVENTION

1. Field of the Invention

The invention relates to methods and devices for treating fiber webs and in particular to methods and devices for preventing pressure peaks at the edges of a fiber web passing over a treatment roll having a pressing shoe.

2. Description of Related Technology

Pressing devices which include a pressing station comprising a roll and a counter roll defining a roll gap through which a material web is conveyed are well known. A pressing roll may include a pressing shoe disposed within a flexible shell that has a ring-like cross-section. The pressing shoe is disposed within the shell and presses against an inside surface thereof by utilizing pressing units and/or pressure relief units disposed over a width of the pressing shoe and distributed in a direction transverse to the direction of movement of a web through the roll gap.

If such a pressing device is utilized to remove water from a paper web, the two edges of the paper web may be dewatered more thoroughly than the other regions of the paper web, especially when the paper web being produced has a smaller width than that normally conveyed through the pressing device. In such a case, there must be a reduction in the pressing force in the area of the web edges.

Pressure relief units for press rolls disposed in various ways in the vicinity of paper web edges are known from J. M. Voith GmbH Company Document P 4007 (deposited in the Library of the German Patent Office (Office for Company Documents) on May 20, 1983). In such devices, the pressing shoe is disposed on a carrier body. A pressure chamber that can be filled with a pressure medium is provided between the pressing shoe and the carrier body. Pressure relief is provided by at least one ring element which extends in the direction of the pressing force. An interior space defined by the ring element is sealed against the rest of the pressure chamber and is connected to a pressure relief line. Preferably, in such a device, two ring elements are disposed next to one another at each end region of each shoe press.

To provide sufficiently sensitive pressure relief at the edges of fiber webs of various widths, the pressure in the outermost of the two ring elements must first be gradually decreased to a minimum pressure and then the pressure at the second (interior) ring element is decreased. Such a design may be disadvantageous because the control and adjustment of the ring elements is costly.

SUMMARY OF THE INVENTION

It is an object of the invention to overcome one or more of the problems described above. It is also an object of the invention to provide a method for sufficient and sensitive adjustment of the relief of pressure at the edges of a web as well as a simple edge pressure relief device, which can be easily understood and operated without any special knowledge of control technology. Furthermore, an object of the invention is to provide such a device wherein the adjustment of edge pressure relief may be accomplished by visual means.

It is an alternative object of the invention to provide an analog edge pressure relief device which adjusts automatically, depending on the position of a fiber web edge. Another object is to provide such a device which is not analog but acts at sufficiently narrow edge zones by turning on and off pressing/pressure relief elements with reference to the fiber web edge position. Such zones preferably have widths that are in easily identifiable quantities, expressed both in millimeters and inches, in order to facilitate operation. Furthermore, an object of the invention is to design such zone widths to be smaller than the distances between the centers of the pressing/pressure relief elements disposed in a line oriented transversely to the direction of movement of a web through the device, as a result of which the number of the pressing/pressure relief elements can be kept small.

According to the invention, a method and device for treating a fiber web includes the conveying and pressing of a fiber web through a pressing gap of a pressing station of the device. The station comprises a pressing roll and a counter roll. The pressing roll has a roll shell. A pressing shoe is disposed within the roll shell and pressing/pressure relief units are disposed substantially along a width of the pressing shoe transverse to the direction of movement of a fiber web through the pressing station. The pressing/pressure relief units include pressing/pressure relief elements. The pressing force of the pressing/pressure relief elements is reduced zone-by-zone and stepwise from a linear force operating level to a lower level in a region that includes the fiber web edges and the pressing shoe ends.

Other objects and advantages of the invention will be apparent to those skilled in the art from the following detailed description taken in conjunction with the drawings and the appended claims.

BRIEF DESCRIPTION OF THE DRAWINGS

FIG. 1 is a partial sectional view of a device according to the invention.

FIG. 2 is a graph showing linear force P vs. length L near an end region of the device shown in FIG. 1.

FIG. 3 is a sectional view taken along the line I—I of FIG. 1.

FIG. 4 is a partial sectional view of the device of FIG. 1 shown with a fiber web having a smaller width than the fiber web shown in FIG. 1.

FIG. 5 is a graph showing linear force P vs. length L near an end of the device shown in FIG. 4.

DETAILED DESCRIPTION OF THE INVENTION

Figure 6:
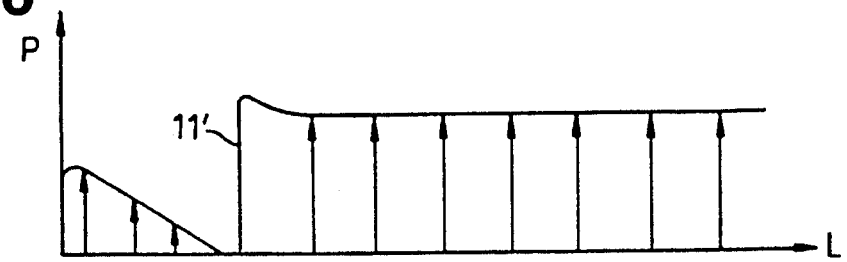
FIG. 6 is a graph showing linear force P vs. length L near an end of the device shown in FIG. 4 for a reduced pressing force near the end thereof.

A pressing device according to the invention which can accommodate paper webs of narrow width includes a pressing shoe disposed in a shell that is flexible, rather than rigid, causing an overhanging load at the edges of the shoe that bends the shoe downward, resulting in a pressure distribution in the region of the fiber web edges that is not uniform and exhibits substantially high pressure peaks. Such pressure peaks can be satisfactorily reduced by providing sensitive pressure relief of the pressing shoe pressure according to the invention. Other than a fiber web, one to two felts and possibly a soft rubber coating typically run through a roll gap. Both the fiber web and the felt may have a thickness and elasticity which varies as a function of time. Thus, uniform pressing of the fiber web edges can be only approximately provided. A solution to the problem of over-pressing fiber web edges must ensure that the pressure peaks on the web edges are not so high that the felts, rubber coating, or the fiber web become damaged and also that the fiber web does not develop low pressure (moist) bands adjacent to the over-pressed fiber web edge resulting from a damping function of the elastic shell which overhangs the ends of the pressing shoe.

By providing local, sudden decreases in the pressing force utilizing pressing/pressure relief elements according to the invention, preferably in the region of the fiber web edges, the pressing on the fiber web edges is reduced. As defined herein a "pressing/pressure relief element" provides at least one of a pressing force and pressure relief. Unloading the pressing/pressure relief elements over an area that extends from the fiber web edges to the ends of the pressing shoe also results in a reduction of the drive power.

Furthermore, according to the invention, reduction of the pressing force is possible over one or several neighboring narrow controllable zones. Depending on the fiber web width, these zones are preferably smaller (i.e. more narrow) than about 125 mm. The width of the zones may be smaller than the distance between the center lines of pressing/pressure relief elements. For example, the distance between centers of the pressing/pressure relief elements can be 200 mm and the zone width can be 100 mm. In such an embodiment according to the invention, zone-by-zone pressure relief is achieved by carrying out the relief of force in two steps for each pressing/pressure relief element instead of using one step. This is possible because over short distances the pressing shoe has sufficient bending stiffness to equalize the pressure relief, i.e., the stiffness of the shoe itself does not permit significant bending over short distances (for example, 50 mm to 100 mm). Therefore, for example, the effect of a 200 mm wide zone at the edge of a paper web where the pressure is relieved 50%, is almost the same as that of a fully relieved zone with a width of 100 mm. The thinner and more flexible the pressing shoe, the smaller the required distance between pressing elements to make such a step-wise relief of force possible without great errors. If the pressing/pressure relief elements are not controlled automatically with respect to the position of the paper web edges, it is expedient to carry out a zone-by-zone activation and deactivation of the edge pressing/pressure relief elements in such a way that easily identifiable zone widths are produced. For example, the zone widths are preferably about 25 mm (1 inch), 50 mm (2 inches), 75 mm (3 inches), and 100 mm (4 inches). These measurements are easy to recognize in both the metric and English (inch) system, so that computation errors can be avoided. For example, zone widths of 38 mm (1.5 inches) and 65 mm (about 2½ inches) should generally be avoided.

In order to reduce the pressure peaks at the paper web edge to a tolerable degree, it is expedient to carry out pressure relief of a sufficient magnitude, e.g., at least about 40% to about 50% of the linear force based on the controlled zone width. "Tolerable" is defined herein not only in the sense of sufficiently high safety against failure (e.g. failure of a roll cover or a pressing shoe or mantle), but so that if a wider fiber web is subsequently processed, no moist strips will be produced as a result of excessive wear of the roll cover, shell, or felt.

Because providing a plurality of pressing/pressure relief elements at each zone increases the cost of the device, according to the invention the zone widths are designed to be smaller than the distance between neighboring pressing elements disposed in a line transverse to the direction of movement of a fiber web through the device. Furthermore, it is unnecessary to provide the same number of pressing/pressure relief elements in each row. A "row" of pressing/pressure elements is defined herein as a plurality of pressing/pressure relief elements forming a substantially straight line (i.e. being flush to one another) oriented in the same direction as the direction of conveyance of a fiber web through the device, while a "line" of pressing/pressure elements is defined herein as a plurality of pressing/pressure relief elements forming a substantially straight line (i.e. being flush to one another) oriented in a direction transverse to the direction of conveyance of a fiber web through the device. For at least in one row of pressing/pressure relief elements, it is possible to reduce the pressing pressure $p_1$ to a pressure $p_2$ (e.g., from a pressing force $F_{max}$ to a lower pressing force $F_{min}$), in one step or in two steps, depending on the width adjustment of the fiber web edge. For example, in a two-step adjustment, the pressure may go from $p_1$ to $(p_1+p_2)/2$ to $p_2$ (e.g., from a pressing force $F_{max}$ to an intermediate pressing force $F_{middle}$ to a pressing force $F_{min}$).

The number of pressure levels n in each pressing/pressure relief element can be formulated as:

$$n=(xz/z)+1=(a/z)+1,$$

wherein x=a/z=number of pressure steps;

a=the distance between the rows of pressing/pressure relief elements (i.e. distance between centers of neighboring pressing/pressure relief elements in a direction transverse to the direction of conveyance of a fiber web through the device, the neighboring elements may or may not be disposed in the same line); and z=zone width.

In an embodiment of the invention wherein the pressing forces of the pressing/pressure relief elements of neighboring rows are not the same at full load, for the same pressures $p_1$ and $p_2$ from one row to a neighboring row, an unequal pressure reduction results when the pressure is reduced from $p_1$ to $p_2$. This is especially true in an embodiment wherein three large pressing/pressure relief elements are disposed in three lines, each line disposed transverse to the direction of movement of a fiber web through the device, and the elements of the middle line are disposed in the gaps of the outer lines and the areas of all pressing/pressure relief elements are approximately the same (e.g., see the cylinder and piston elements 14 in lines 25, 26, and 27 of FIG. 8). In an embodiment of the invention having two pressing elements per row, in the middle line, the force is reduced by a factor of F and in the outer lines by 2F. As a result of this change, equivalent pressure relief zone widths of z and 2z, etc., will arise. The same width of the pressure relief zone z is produced by carrying out the pressure relief in rows with two pressing/pressure relief elements in the outer lines in two steps from $p_1$ to $(p_1+p_2)/2$ to $p_2$ when the width of the fiber web is reduced by a width z.

Preferably, zone control is not provided over an entire fiber web width, (i.e., the pressing shoe width), because extremely narrow width webs are typically not produced as they are not cost effective. Thus, zone control is provided only in the region of an edge or both edges of a pressing shoe, e.g., only about 5% to about 10% of the full width of the fiber web. Uniform pressing force is typically required in the middle region of the pressing shoe (and a paper web).

Uniform pressing force over the paper web width is best provided by hydraulic pressure on a bottom side of the pressing shoe. For this purpose, the base of the pressing shoe is designed as a rectangular piston, which is enveloped by a rectangular chamber or trough, sealed toward the piston and filled with a pressure fluid medium. In such an embodiment, pressure relief may be provided in a rather complicated manner by utilizing tension elements disposed at the edges of the pressing shoe which act in a direction opposite the edges of the shoe. A simpler embodiment according to the invention includes providing a pressure relief cylinder disposed in the rectangular chamber in which the pressure is adjusted to be smaller than in the plenum (i.e. rectangular chamber). However, the pressure relief provided by the cylinder must be sufficiently high. Therefore, the relative area of the pressure relief cylinder is sufficiently large, e.g., about 40% or more of the piston area of the base of the pressing shoe. This is made possible by using rectangular, oval, or cylindrical, pressing/pressure relief elements disposed in several lines and displaced (i.e. offset) with respect to one another from line to line.

The step-wise, sudden change of the pressing forces between neighboring rows of pressing/pressure relief elements in the edge region of the pressing shoe avoids undesirable pressure peaks on the fiber web edges. In principle, pressure peaks could also be avoided by providing a continuous change of the pressure in individual pressing/pressure relief elements which would require a very complex and complicated control system.

The step-wise activation and deactivation of pressing/pressure relief element pressure levels according to the invention addresses the problem of zone-by-zone narrowing of a fiber web. For example, if the fiber web edge narrows by 25 mm to 75 mm toward the middle of the machine, this means the pressure relief of a 50 mm wide zone, while a narrowing of 75 mm to 125 mm at one edge then requires pressure relief of two 50 mm wide zones.

The distances between the center lines of the rows of pressing/pressure relief elements in a direction transverse to the direction of movement of a fiber web through the device must exhibit a balanced ratio to the bending stiffness of the pressing shoe. Because it is desirable to design the pressing shoe as thin and flexible as possible to avoid local overpressing, the distance between neighboring rows must not be too high. In light of the pressing shoe thickness preferably used with the invention, the distance between rows should not be more than about 150 mm. Larger row distances lead to local pressing shoe deformations with undesirable non-uniform pressure distribution due to the flexibility and low bending stiffness of the thin pressing shoe.

Based on purely psychological considerations, the distances between the pressing/pressure relief elements is preferably chosen to be a multiple of about 25 mm (1 inch). As a result, it becomes possible to provide zone-by-zone edge pressure relief with easily identifiable (marked) zone widths (that can be relieved step-wise) of, for example, 25 mm, 50 mm, 75 mm, or 100 mm (respectively, 1 inch, 2 inches, 3 inches, or 4 inches). A preferred zone width is less than 120 mm and an optimum zone width is preferably about 50 mm (about 2 inches) or about 75 mm.

Among the embodiments of a pressing system according to the invention, the following two are preferred:

(1) An elongate pressing shoe which is as wide as the pressing machine is pressed against a pressing zone by several pressing/pressure relief elements disposed in an arbitrary number of lines.

(2) The pressing shoe is pressed by an elongate pressing element which is as wide as the pressing device. The pressing shoe and the pressing element can form a single structural unit or can be in several parts. Preferably the pressing shoe and pressing element are in two parts joined to one another by a rocker joint.

In the embodiment of paragraph (1), the pressing/pressure relief elements are disposed in a single line or in several lines, all of which are oriented transversely to the direction of travel of a fiber web through the device. The embodiment also includes pressing/pressure relief elements disposed in a plurality of rows oriented in the direction of movement of the web and to which the same linear force is applied. Pressure relief at the edges of the pressing shoe (and thus the edges of a fiber web) is accomplished by relieving the pressure along select individual rows of pressing/pressure relief elements in the region of the web edges, and optionally also outside the web edges.

In order to minimize the height of the pressing/pressure relief elements, which are preferably designed as pressing cylinders, components such as piston rods and rocker joints should be avoided. Pistons disposed in the pressing cylinders press against a planar counter-surface, for example, against a bottom side of the pressing shoe. In spite of this, angular adjustment between the cylinder and the counter surface should be possible. Therefore, the piston disposed in the pressing cylinder is designed so that it can move spheroidally. The spheroidal movement of the piston is necessary only in a small angular region, for example, up to about 2°. On the other hand, the stroke of the piston must be several centimeters. There is a danger that the piston will tilt in the cylinder, for example, when the piston is pressed from a lowermost position against a shoe disposed in an uppermost position. This danger is eliminated by incorporation of one or more pressure springs in the cylinder which keep the piston in contact with the appropriate pressing surface. If such continuous contact is provided, a pressure relief pocket can be built into the piston surface that is against the pressing surface of the shoe. Then the pressing force on the pressing surface is partially produced directly by hydraulic forces. When the pressure in the pressure relief pocket corresponds to the cylinder pressure, the pressure relief pocket should have at most the same size as the piston surface. Otherwise, the piston would move away from the pressing surface and the pressure medium would undesirably flow between the piston and the pressing surface that could lead to an increase of energy consumption or even to exceeding the pumping capacity of a cooperating supply pump.

A particularly preferred device according to the invention is provided when the pressure springs and the pressure relief pockets described herein are used at the same time or in combination with one another when the piston is pressed against a planar surface (i.e. the bottom side of the pressing shoe) over a large area. When the planar surface is displaced angularly, the piston in the cylinder must be inclined by a small amount and be adapted to slide sideways on the planar surface so that a central axis of the piston is always perpendicular to the planar surface. Furthermore, it is advantageous for the pressing shoe to be disposed in a pressure chamber or trough which is disposed in a support (i.e. carrier) body, with the shoe being guided thereby so that the shoe can move in the direction of pressing and can be tilted in all directions. Apart from the movement of the components in the pressing direction, the positioning of the shoe on the support body is on the trough and not through the cylinder. The pistons are free from the transfer of transverse forces, for example, frictional forces, that arise between the shoe and the pressing shell. The piston/cylinder units are disposed in the bottom of the trough. The piston can press against the pressing shoe and the cylinder can press against the support body or vice verse. Similarly, either the piston or the cylinder can be fixed on a base of the device and against any sideways movement, or can be fixed rigidly.

According to a preferred embodiment of the invention, the trough is filled with a pressure medium and sealed against leakage thereof at a periphery of the shoe. The pressure medium thus produces the pressing force on the shoe. The seal is designed in such a way that the shoe can move in the pressing direction and tilt in all other directions. With this type of construction, the piston/cylinder unit can apply or relieve pressure, depending on whether the inner pressure is greater or smaller than the pressure in the trough.

In order to facilitate mounting of the pistons, the pistons have a maximum stroke limitation with respect to cooperating cylinders. In this way, before incorporation of the pressing shoe, the pistons can be mounted in a cylinder and then on the support body without being pushed out of the cylinders by the springs.

Furthermore, it is preferable and advantageous to dispose the pressing/pressure relief piston/cylinder units in at least three lines, each line running transversely with respect to the direction of travel of a fiber web through the machine (i.e. across the machine width) with the middle line of cylinders displaced (i.e. disposed offset) with respect to the outer two lines of cylinders. As a result of such a configuration of pressing/pressure relief cylinders, within the shoe contour, maximum piston pressing surface is reached and thus a larger force is obtained at lower pressures. At the same time, the size of the pistons remains small allowing compact spacing of the pistons in a direction transverse to the direction of movement.

In an embodiment of a device according to the invention which includes at least three lines of pistons with neighboring lines being displaced or offset with respect to each other, due to this offset configuration and the application of the same pressure to all of the cylinders in the same row (i.e. the cylinders which are next to one another in the 1st, 3rd and 5th lines, etc.), a large pressing force arises and there is a desirable absence of torsional momentum of the pressing shoe when the pressures of neighboring rows are changed with respect to one another. Such an absence of momentum could not be realized, for example, with only two lines of cylinders, displaced with respect to one another. Also the desirable small distance between rows of cylinders could not be achieved with only one line of cylinders.

The pressure in the cylinders can be selectively controlled to provide individual adjustment thereof. However, according to a preferred embodiment of the invention, the highest adjustable pressure is equal to the pressure in the plenum outside of the cylinder. Preferably, the pressure changes only in the direction of pressure relief. For example, according to a method of the invention, the pressure may be reduced within the cylinder to atmospheric pressure in at least one step. In such a case, it is sufficient to provide cylinders for pressure relief only at the edges of the pressing shoe to provide the necessary pressure relief at the edges of a fiber web being conveyed through the device.

Furthermore, the distance between the centers of neighboring pistons on the same line is preferably between about 140 mm and about 160 mm (about 150 mm (about 6 inches) is particularly preferred). Thus, the distance between the center of a piston of an outer line (of a three-line configuration) and the center of a neighboring piston of the middle line of pistons, with respect to a direction transverse to the direction of travel of a fiber web through the device is about 75 mm and the zone width is about 50 mm, when the step-wise decrease of the linear force in the edge region is accomplished so that in the middle line (with the web becoming narrower), the pressure is reduced in the cylinder from $p_1$ to $p_0$ and in the two outer lines, the pressure is decreased in steps of approximately equal magnitude from $p_1$ to $(p_1+p_0)/2$ and then to $p_0$. In this way, a zone width of about 50 mm is obtained by providing step-wise pressure relief on the edge of the pressing shoe.

Starting with a press shoe that is as wide as the pressing device and is pressed from a pressure medium plenum in a trough, pressure relief cylinders as disclosed herein disposed at the end regions of the pressure shoe are usually sufficient. Narrowing of a web by an amount which places the web edges within the pressure relief cylinders is uneconomical since this reduces the machine capacity. Therefore, in the usual case, up to (and including) 14 pressure relief cylinders are usually sufficient for a device and method according to the invention when spaced at distances already described herein.

The pressure relief effect of the pressure relief cylinders must not be 100%, but it must be sufficiently large so that no pressure peaks occur in the region of the narrowed fiber web edges that are significantly above the pressures in the middle pressing region of the device. In order to achieve this, pressure relief of about 40% to about 50% of the line force in the edge region is expedient. This is achieved by the fact that the piston surfaces of the pressure relief cylinders in the edge region represent about 40% to 50% or more of the rectangular area of the particular pressing shoe section. In other words, where there is a pressure shoe length a to be relieved of pressure having a hydraulically pressurized shoe width b, the area of the pressure relief piston in the area of this shoe length a can be, for example, $A>ab/2$. The pressure stepping of the edge cylinders can be done automatically, whereby the position of the edge peaks on a sieve portion of the device serves as a correcting variable. In such an embodiment, a control and adjusting system may be provided based on a measurement of the position of spraying or trim shower nozzles of a wire or forming section of a fiber web making machine which are utilized to aid in the separation of edge strips of a fiber web. The control and adjusting system therefore determines the location and number of zones to activate for reducing pressure and can trigger a continuous reduction of pressing force, zone by zone.

In order to guard against sudden pressure fluctuations in a device according to the invention, pressure limit valves are provided in the region of the pressure relief cylinders. The pressure limit valves ensure that during non-stationary operating stages no impermissible pressure peaks occur which could, for example, damage the felt or pressing shell. This can occur especially upon a sudden pressure drop in the plenum in the trough. By reducing the bending of the supporting body, the supporting body and a counter roll will become closer and this must be compensated by lowering the pressure shoe. However, the shoe can be lowered only when the pressure medium can be removed fast enough from the pressure relief cylinders.

The length of a connecting line between the pressure relief cylinder and the pressure limit valve should be shorter than 1 m so that the pressure relief system is not hindered by inertia.

To provide for a piston of a pressure relief cylinder in a device according to the invention that has a sufficiently large diameter, it is desirable to form the cylinders as bores or as thin-walled sleeves into bores of a common base plate. The base plate is part of a replaceable pressure shoe pressing unit, which has a base plate with a basin, in which the pressing shoe is guided in a sealed manner, and includes seals, a pressure relief cylinder and shoe recovery mechanisms (in the form of springs).

The invention is further described with reference to FIGS. 1–10. FIG. 1 shows a section of a pressing device according to the inventions generally designated 1, in a partial section transverse to the direction of movement of a fiber web through the device. The pressing device 1 include a pressing station, generally designated 2, including a roll shell or body 3 that has an annular cross-section. The shell 3 forms a pressing gap (i.e. roll gap) with a counter roll 4. A pressing shoe 5 is disposed within the shell 3 and can be pressed against an inner surface 6 of the shell 3. The pressing shoe 5 is pressed against the inner surface 6 by a plurality of pressing units shown in FIGS. 1 and 3 as pressing elements 7 and 7'.

A paper web 9 and at least one pressing felt 10 move through a pressing zone 8, which is shown including the shell 3. Thus, the pressing zone 8 is disposed between the counter roll 4 and the pressing shoe 5. The paper web 9 has a web edge 11 disposed near a front face 12 of the pressing shoe 5. With reference to FIG. 2, if the web edge 11 is in the position shown in FIG. 1 and if all of the pressing elements 7 apply the same pressure, a uniform distribution of a linear force p over a width L of the pressing shoe 5 is obtained, beginning from the edge 11 of the paper web 9.

FIG. 3 is a sectional view of the embodiment of the invention shown in FIG. 1 which shows the pressing elements 7 and 7' and a bottom contact surface of the pressing shoe 5. The pressing shoe 5 is contacted and pressed against by the pressing elements 7 and 7' which are in the form of pistons having surfaces that press against the pressing shoe 5 which in turn presses against the pressing shell 3. The pressing elements 7 and 7' shown in FIGS. 1 and 2 are disposed in two lines transverse to the direction of conveyance of the web 9 through the device 1.

FIG. 4 illustrates the device 1 with a paper web 9' that is more narrow than the paper web 9 shown in FIG. 1. The web 9' has a web edge 11'. Based on a finite thickness d of the paper web 9' at the edge 11', a step occurs in the thickness of a pocket formed by the paper web 9', the pressing felt 10 and the shell 3 pressed through the pressing zone 8. Depending on the compressibility of the felt 10, the pressing shell 3 and the counter roll 4, a smaller or larger gap or void 13 is produced outside of the paper web edge 11'. In the gap 13, the linear force drops to zero or almost zero. Thus, because of the presence of the gap 13, if all of the pressing elements 7 have the same pressing force applied to them, uniform distribution of a linear force cannot be provided through the width of the paper web 9' transversely to the direction of movement of the web 9', except with the assumption that both the counter roll 4 as well as the pressing shoe 5 are completely stiff against bending. However, typically, the pressing shoe 5 is very bendable (i.e. plyable) and it can be deformed by a factor of about $10_4$ more than the counter roll 4 at the same bending moment. As a result of this, an end of the pressing shoe 5 bends considerably in the relatively short distance between 11 and 11' under the influence of the bending moment that arises from the pressing force of a pressing element 7' acting outside of the web edge 11'. Consequently, the linear force distribution shown in FIG. 5 is obtained wherein a stronger pressing force occurs immediately next to the web edge 11'. Due to such a pressing force, the shell 3 and the felt 10 become more worn in this region causing the fiber web to develop low pressure bands at the edges thereof, illustrated by a low pressure area A in FIG. 5. This lack of pressing uniformity can be compensated for or reduced by reducing the pressing forces of the outer pressing elements 7' according to a method of the invention. The linear force distribution that can be obtained by practicing a method of the invention is shown in FIG. 6. In order to achieve the linear force curve of FIG. 6, it is typically not necessary to set the pressing forces to zero outside of the web edge 11'. A strong reduction of the pressing force, for example, about 40% to about 70% is sufficient.

Figure 8:
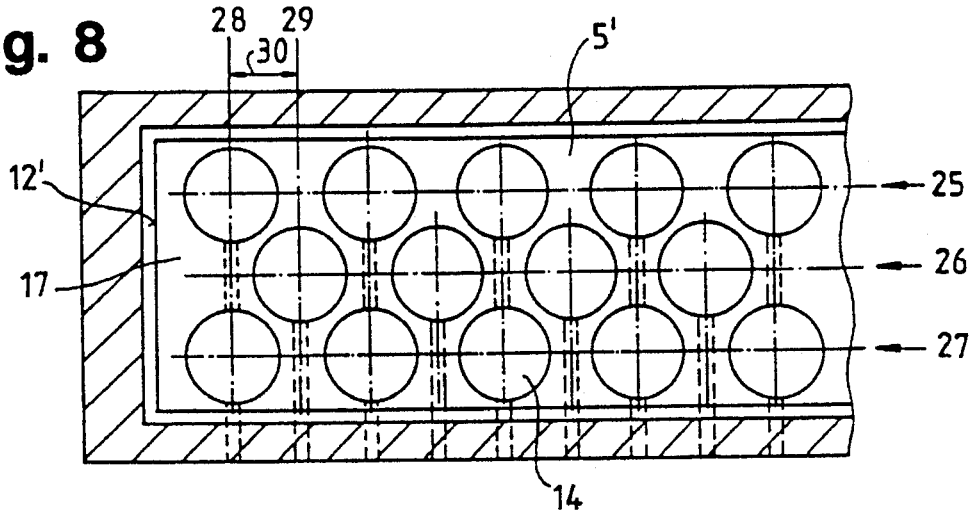
FIG. 8 is a sectional view taken along the line VIII—VIII of FIG. 7.
Figure 7:
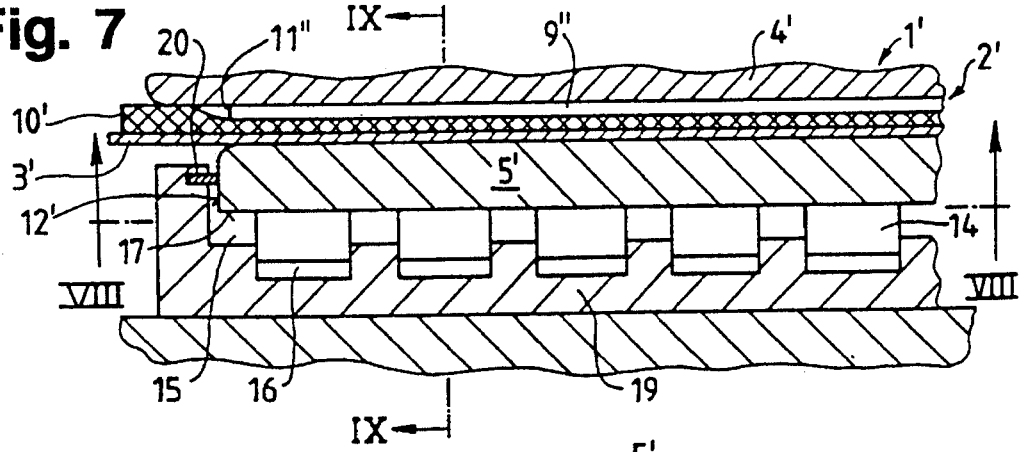
FIG. 7 is a partial sectional view of a second embodiment of a device according to the invention.
Figure 9:
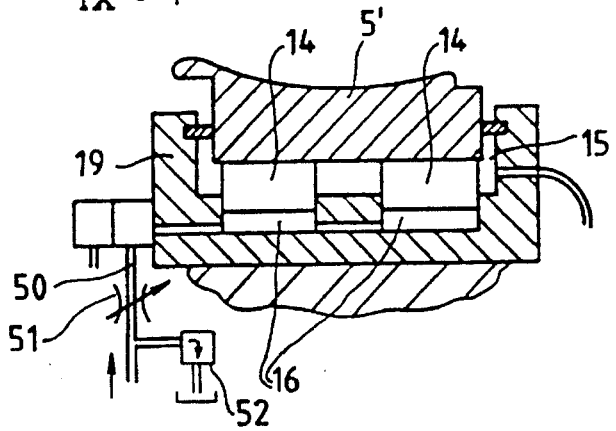
FIG. 9 is a sectional view taken along the line IX—IX of FIG. 7.

FIGS. 7–9 illustrate a second embodiment 1' of a device according to the invention having elements designated by the reference numerals 2', 3', 4', 6', 10', and 12' similar in form and function to the elements designated by the reference numerals 2, 3, 4, 6, 10, and 12, respectively, described with respect to FIGS. 1, 3, and 4. FIG. 7 shows a sectional view of the inventive pressing device taken along a pressing line. A pressing shoe 5' is disposed in a pressure chamber 15 filled with a pressure medium, the shoe 5' being pressed toward the counter roll 4' by the pressure medium as well as by pressing/pressure relief elements in the form of pistons 14 disposed in cylinders 16. Pressure is applied to a piston 14 in a cylinder 16. The shoe 5' is also guided by the chamber 15 against movement perpendicular to the direction of pressing. In contrast to the pressure in the pressure chamber 15, the pressure in the cylinders 16 applied to the pistons 14 can be varied. The pressure can be made the same, larger, or smaller than the pressure in the pressure chamber 15. However, if the pistons 14 are disposed in three lines 25, 26, and 27 as shown in FIG. 8, the piston pressure does not have to be greater than the pressure in the inside chamber of the pressure chamber 15.

A reduction of the pressure on the pistons 14 in the cylinders 16 in a region 11" of a paper web 9" being conveyed through the device 1' and a similar reduction of pressure outside of the paper web edge 11" is sufficient to provide good linear force distribution because with the three-line configuration shown in FIG. 8, the fraction of the piston surfaces on which the pressure is relieved can be made sufficiently large. For example, pressure can be relieved over more than 50% of a rectangular area 17 of the pressing shoe 5' to which pressure is applied through the inner chamber of the pressure chamber 15. Thus, the pistons 14 in a middle part of the pressing shoe 5 are not required as pressure relief elements are only needed where it is foreseen that narrow width paper web edges will be disposed.

With reference to FIG. 7, if the width of the web 9" would be even more narrow and thus the edge 11" of paper web 9" would be disposed to the right, then the pressures in the pressure relief cylinder 16 would be reduced successively to zero from left to right, i.e., from the pressing shoe front face 12' in a direction toward the new position of the paper web edge 11". The control of the pressure reduction must occur according to a strict logic so that, as a narrowing of the web progresses, the pressure is reduced from p to zero in an outer row 28 of the cylinders 16 and, as the web is narrowed further, the pressure will be reduced in a second row 29 of cylinders and so forth. However, such a method requires costly control technology and therefore the pressures are reduced according to the invention in a step-wise (i.e.

incremental) manner. For example, in the rows where two cylinders 16 are present (one each in lines 25 and 27), the pressure is reduced in two steps and in the rows where there is only one cylinder (in line 26) the pressure is reduced in one step. The width of the control zones thus obtained is for example, about ⅔ of the distance 30 between the rows 28 and 29. In this way, it is possible to keep the zone width small enough so that analogous pressure regulation in the pressure relief cylinders is not necessary.

With reference to FIGS. 7 and 9, the pressing shoe 5' is designed as a rectangular piston which can be tilted in a trough 19 and is held so that it can be shifted perpendicularly to the plane of the drawing. A periphery of the pressing shoe 5 is sealed against the trough 19 with sealing strips 20.

Figure 10:
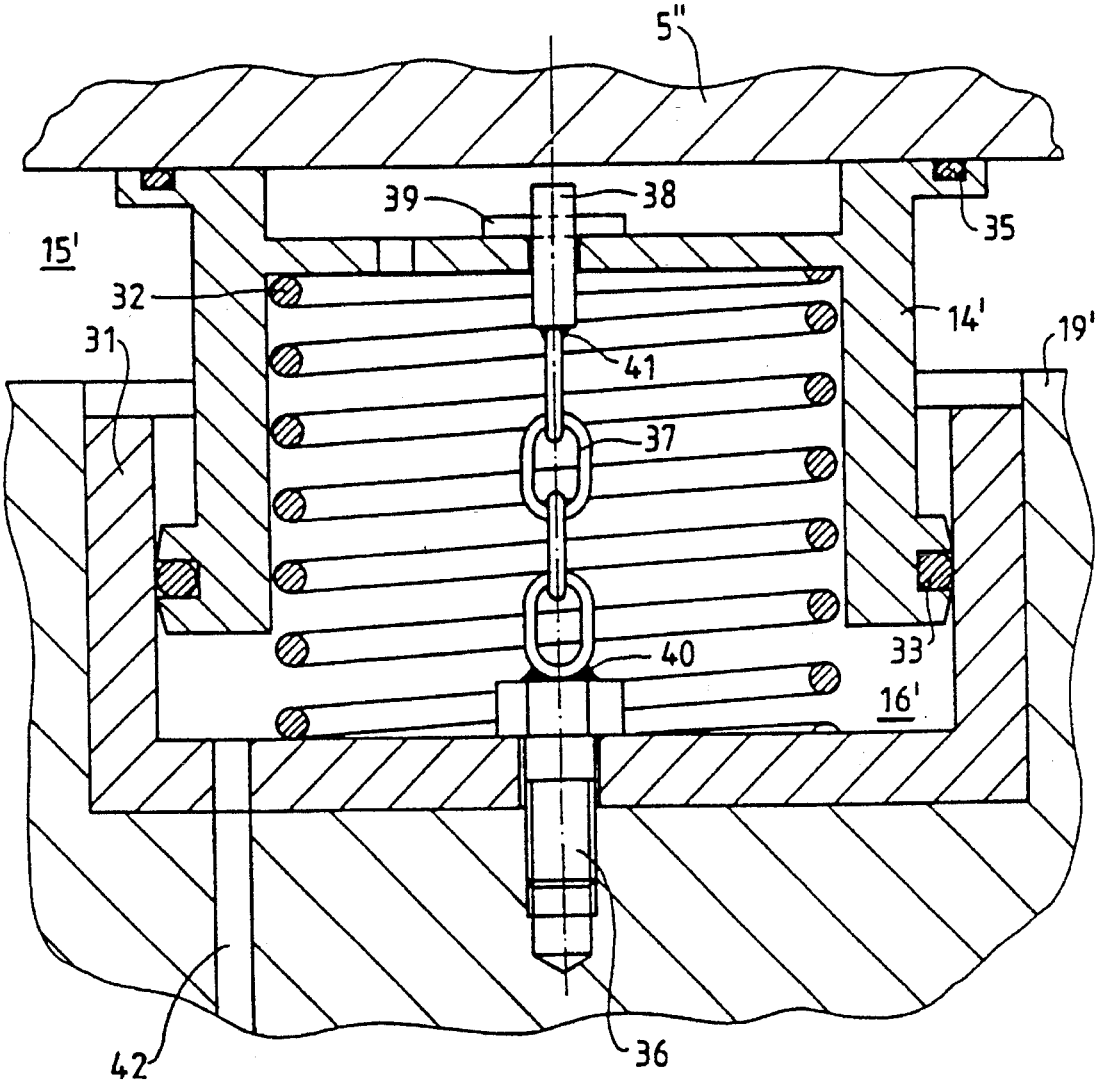
FIG. 10 is a partial longitudinal sectional view of the device of FIG. 7 showing a pressing/pressure relief element according to the invention.

FIG. 9 shows the edge pressure relief units of FIGS. 7 and 8 (i.e. the piston 14 disposed in the cylinder 16 which presses against the pressing shoe 5') in cross-section. In order to control the pressure, the cylinder 16 is connected to pressure control lines 50 having pressure control valves 51 disposed therein. Pressure limit valves 52 are also connected to the pressure control lines 50. FIG. 10 illustrates a cross-section of a second embodiment of an edge pressure relief unit which may be utilized with the embodiment of the invention shown in FIGS. 1, 3, and 4 and also with the second embodiment of the invention shown in FIGS. 7–9. With respect to FIG. 9, the cylinder 16 is incorporated directly into the trough body 19. However, in the embodiment shown in FIG. 10, a cylinder 16' is formed by a separate pot 31 disposed in a trough body 19'. A piston 14' is pressed against a bottom side of a pressing shoe 5" with a spring 32. The piston 14' can move up and down in the cylinder 16' and is guided so that it can be tilted. A sealing ring 33 and a sealing ring 35 ensure sealing of the cylinder chamber 16' against a plenum 15'.

In FIG. 10, a screw 36 with a chain 37, bolts 38, and a key 39 ensure that the piston 14' cannot move out of the cylinder 16' during mounting. The chain 37 is welded to the screw 36 at 40 and to the bolt 38 at 41. The cylinder-piston unit 16'/14' can be used both as a pressure relief cylinder according to FIGS. 7 to 9, as well as a loading cylinder according to FIGS. 1, 2 and 4. In the former case, the hydraulically effective diameter of the sealing ring 35 must be somewhat larger than the cylinder diameter while in the second case it has to be somewhat smaller. A pressure control line 42 is connected to the cylinder 16'.

Figure 11:
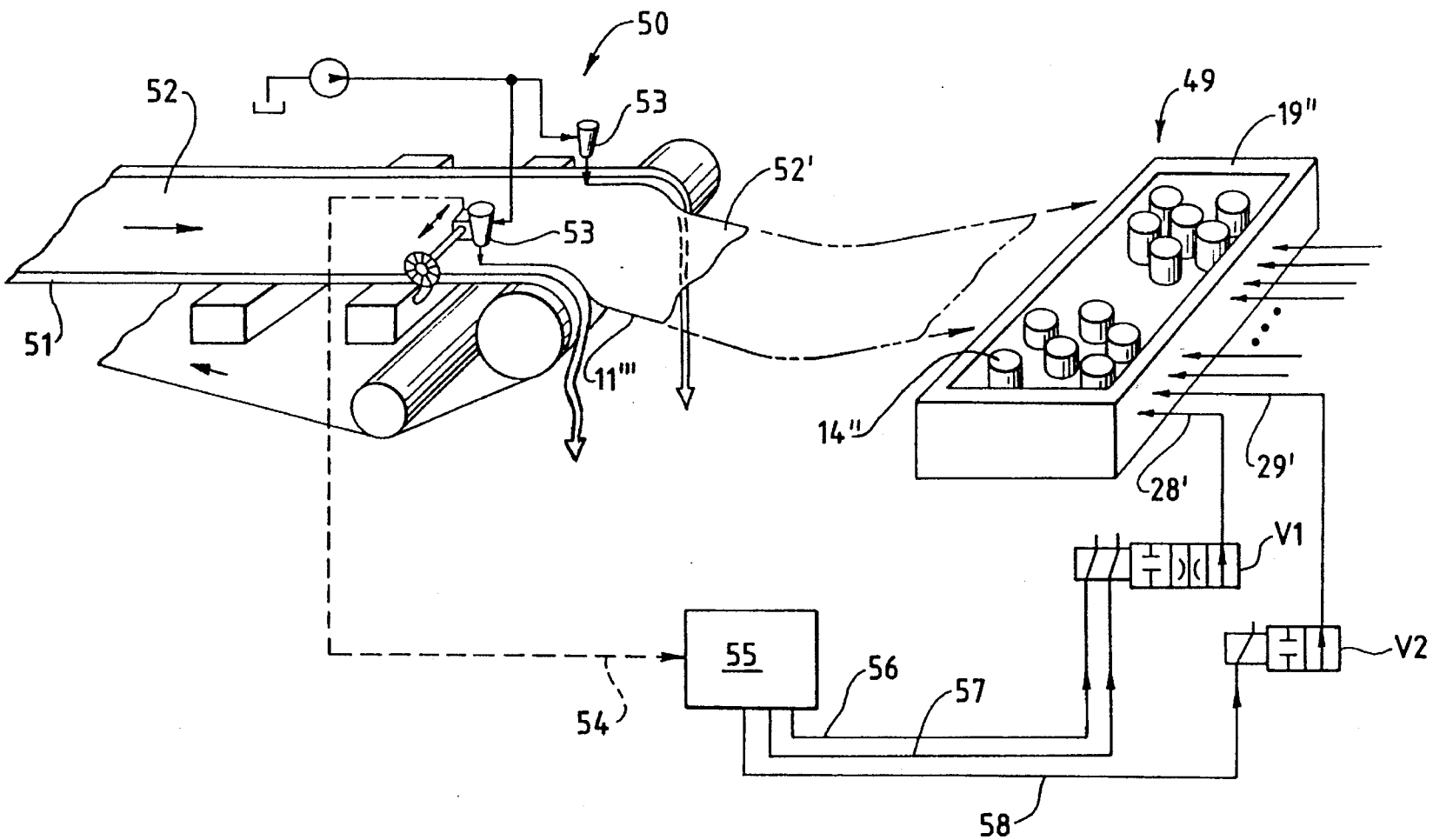
FIG. 11 is a partially schematic perspective view of a third embodiment of a device according to the invention.

FIG. 11 shows a device according to the invention having a press section 49 and a wire (i.e. forming) section 50. The device includes a control and adjusting system according to the invention which includes means for measuring the position of spray nozzles or trim showers 53 disposed on the wire section 50. The trim showers 53 aid in the separation of edge strips from a fibrous material suspension 52 transported on a wire belt 51. Based on a measurement of the position of the trim showers 53, the number of zones of a pressing shoe in which pressure must be released can be determined. Therefore pressure is controlled by monitoring the position of the trim showers 53 on the wire section 50 and regulating the pressure placed on a fiber mat 52' by activating pressing/pressure relief elements 14' in response to the position of the trim showers 53.

In FIG. 11, a top portion of a pressing shoe is removed (i.e. not shown) to provide a view of pressing/pressure relief elements (piston and cylinder units) 14" disposed in a trough 19". The elements 14" place pressure on the pressing shoe (not shown) of the pressing section 49 in a manner as described herein with respect to FIGS. 7–10. However, only the relationship between the position of the trim showers 53 and the adjustment of the pressing/pressure relief elements 14' are illustrated in FIG. 11.

In the wire section 50, the trim showers 53 spray fluid on the fibrous material suspension 52 transported on the wire belt 51 and thus aid in the separation of edge strips from the suspension 52 which establishes the width of the formed fibrous material web 52'. The trim shower position is adjustable and thus variation of the width of the fibrous material web 52' is possible. The trim showers 53 therefore, also determine the position of a web edge 11'" with respect to the pressing shoe of the pressing section 49. By determining the position of the trim showers 53 in the wire section 50 and thus the expected position of a fiber web edge 11'" with respect to the pressing shoe of the pressing section 49, a determination of where pressure should be released can be made and the appropriate elements 14" activated. For example, in FIG. 11, a signal regarding the position of the trim showers 53 with respect to the wire section 50 is introduced to an input 54 of a control or regulating unit 55. The control unit 55 has several outputs which can be coupled with appropriate means to control the pressing force of individual rows, for example, rows 28' and 29', of the elements 14" disposed in the same direction as the direction of movement of the fibrous material web 52' through the pressing section 49. As shown in FIG. 11, based on the position of the edge 11'" of the fibrous material web 52' as it is conveyed through the pressing section 49, a signal sent to decrease pressure in rows 28' and 29' is sufficient to perform a method according to the invention. A first output 56 and a second output 57 are therefore coupled with a control valve V1 which is coupled to the pressing/pressure relief elements in the row 28' and serves for their activation (i.e. pressure release in this instance). The valve V1 can also cooperate with the pressing/pressure relief elements in the row 28' to provide a decrease in pressure in two steps. A third output 58 is coupled to a second control valve V2 which serves to decrease the pressure in the row 29' in one step.

The foregoing detailed description is given for clearness of understanding only, and no unnecessary limitations should be understood therefrom, as modifications within the scope of the invention will be apparent to those skilled in the art.

I claim:

1. A method of treating the edges of a fiber web in a pressing device comprising the steps of:

conveying and pressing a fiber web through a pressing gap of a pressing station of said device, said station comprising a pressing roll and a counter roll, said pressing roll having a flexible roll shell;

providing a pressing shoe disposed within the roll shell and pressing/pressure relief units disposed substantially along a width of the pressing shoe extending in a direction transverse to a direction of movement of the fiber web through the pressing station, said pressing/pressure relief units positioned and arranged so as to press against the pressing shoe and in turn press a pressing surface of the shoe against an inner surface of the roll shell in a series of zones, said pressing/pressure relief units including pressing/pressure relief elements; and suddenly reducing the pressing force of the pressing/pressure relief elements zone-by-zone in a region defined by the ends of the pressing shoe to the edges of the fiber web and in a direction transverse to the direction of movement of the web wherein a zone operating at a first pressing operating level is suddenly reduced to a lower pressing level than a neighboring zone in the vicinity of said region defined by the fiber web edges and the pressing shoe ends.

2. The method of claim 1 wherein the pressing force reduction step is performed only in the vicinity of the fiber web edges.

3. The method of claim 2 wherein the pressing force reduction step is performed zone-by-zone in fixed steps.

4. The method of claim 1 wherein the pressing force reduction step is performed zone-by-zone in steps from a maximum force $F_{max}$ to a minimum force $F_{min}$.

5. The method of claim 1 wherein the pressing force reduction step is performed zone-by-zone in three steps from a maximum force $F_{max}$ to an intermediate force $F_{middle}$ to a minimum force $F_{min}$.

6. The method of claim 1 wherein the pressing force is reduced through at least two zones, each zone having a width of less than 120 mm.

7. The method of claim 6 wherein the pressing force is reduced in incremental zones of 25 mm each.

8. The method of claim 1 wherein the reduction of the pressing force is at least about 40% of the force acting through the width of the zones.

9. The method of claim 1 wherein the pressing/pressure relief elements comprise pistons disposed in cylinders, the cylinders being disposed in rows oriented in the same direction as the direction of conveyance of the fiber web through the pressing station, and wherein the pressing force can be changed in individual rows of cylinders in steps, the number of steps being defined as:

$$n=a/z+1$$

wherein n=number of pressure steps;

a=the distance between rows of pressing/pressure relief elements; and z=zone width.

10. The method of claim 1 wherein the pressing/pressure relief elements are disposed in rows, each row being oriented in the same direction as the direction of conveyance of the fiber web through the pressing station, each row equally spaced from a neighboring row with respect to a direction transverse to the direction of movement of the fiber web, and wherein the pressing forces vary from row to row in the following ratio:

$$F_{max}/\frac{F_{max}-F_{min}}{2}/F_{min}$$

wherein $F_{max}$=maximum force and $F_{min}$=minimum force.

11. The method of claim 10 wherein, when the fiber web width narrows, the reduction of the pressing force on a row with a smaller pressing force is performed in one step from the maximum force $F_{max}$ to the minimum force $F_{min}$ and in the rows with the larger pressing force in two steps from the maximum $F_{max}$ through an intermediate force $F_{middle}$ to the minimum force $F_{min}$.

12. The method of claim 1 further comprising:

providing a pressure chamber having a width substantially equal to the width of the pressing station and wherein the pressing/pressure relief elements are pressure-relieving cylinders disposed in the chamber, a remainder of the chamber being filled with a pressure fluid forming a pressurized plenum surrounding the cylinders, said cylinders having a pressing surface cooperating with the pressing shoe to provide a pressure against the pressing shoe at least as large as a pressure placed on a residual pressing surface of the shoe by the plenum; and reducing the pressure within the pressure-relieving cylinders to atmospheric pressure in at least in one step.

13. The method of claim 1 further comprising:

providing a control and adjusting system and trim showers, said trim showers positioned and arranged so as to separate edge strips of the fiber web, said control and adjusting system for determining a position of the fiber web edges based on a measurement of a position of the trim showers and determining and activating the number of zones wherein the pressure on the pressing shoe is to be reduced.

14. The method of claim 13 wherein the pressure reduction is performed in steps from zone-to-zone.

15. A method of treating the edges of a fiber web in a pressing device comprising the steps of:

conveying and pressing a fiber web through a pressing gap of a pressing station of said device, said station comprising a pressing roll and a counter roll, said pressing roll having a roll shell;

providing a pressing shoe disposed within the roll shell and pressing units disposed substantially along a width of the pressing shoe in a direction transverse to a direction of movement of the fiber web through the pressing station, said pressing units positioned and arranged so as to press against the pressing shoe and in turn press a pressing surface of the shoe against an inner surface of the roll shell in a series of zones, said pressing units including pressing/pressure relief elements;

reducing the pressing force of the pressing/pressure relief elements across said zones in a continuous manner from a linear force operating level to a lower level in the vicinity of the edges of the fiber web being conveyed through the device;

further providing a control and adjusting system and trim shower nozzles at edges of a fiber web forming device;

positioning and arranging said trim shower nozzles to separate edge strips from the fiber web;

determining a position of the fiber web edges with said control adjusting system based on measurement of a position of the trim showers and;

triggering one of a continuous reduction or increase of the pressing force zone-by-zone as the trim shower nozzles are moved to change the width of the fiber web.

* * * * *